United States Patent [19]

Desson

[11] Patent Number: 4,522,858

[45] Date of Patent: Jun. 11, 1985

[54] BIG BLOTTER TOWEL

[76] Inventor: Carmen F. Desson, Box 822, Blind River, Ontario, P0R 1B0, Canada

[21] Appl. No.: 330,237

[22] Filed: Dec. 14, 1981

[51] Int. Cl.[3] ..... A47K 10/02

[52] U.S. Cl. ..... 428/96; D6/608; 15/209 R; 15/222; 428/224

[58] Field of Search ..... 428/78, 96, 224; 15/209 R, 222, 227, 229 AC, 229 BC; D6/265, 608; D2/362

[56] References Cited

U.S. PATENT DOCUMENTS

| | | | |
|---|---|---|---|
| 507,833 | 10/1893 | McGinnis | D6/265 X |
| 2,441,745 | 5/1948 | Benamy | 15/227 X |
| 2,574,854 | 11/1951 | West | 15/227 X |
| 3,013,274 | 12/1961 | Dike | D6/265 X |
| 3,130,441 | 4/1964 | Hahn | 15/222 X |
| 4,224,712 | 9/1980 | Black et al. | D6/265 X |
| 4,278,719 | 7/1981 | Sarnecki | 428/78 |

OTHER PUBLICATIONS

Advertisement from the Washington Post/Potomac Magazine Section, May 21, 1972, Note Cannon Rol-A-Towel.

*Primary Examiner*—Henry F. Epstein
*Attorney, Agent, or Firm*—Hirons, Rogers & Scott

[57] ABSTRACT

The present invention relates to a drying towel which incorporates a thin sewn-in or unitized layer of slippery material which lines the two inner surfaces when the towel is doubled-over. When applied to a wet surface the hand pressure and combined lateral hand movement causes the top layer of the doubled-over towel to slide over the lower layer of the towel (along the two inner slippery surfaces) which is in contact with the wet body thereby producing a roll-blotting action. Drying of the body is effected without producing any lateral movement of that part of the towel which is in contact with the body. As a consequence the wet body is dried with no rubbing or abrasive action of the skin surface.

5 Claims, 1 Drawing Figure

BIG BLOTTER TOWEL

DESCRIPTION

Figure 1:
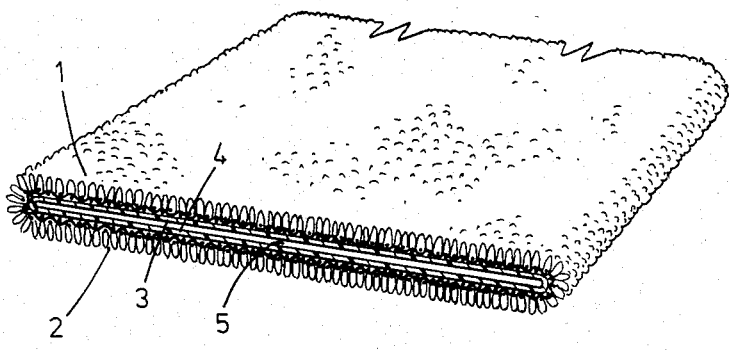

The present invention relates to a towel for drying a wet surface which produces no lateral movement of that portion of the towel which is under hand pressure while in contact with the skin during the drying process.

During normal use, a conventional drying towel is usually grasped and applied to a portion of the wet body in a normal rubbing motion to effect absorbing of the moisture on the skin in order to dry it. This results in an abrasive, scraping type action of the towel surface against the skin with several adverse results.

The normal towelling procedure for drying by rubbing produces a scraping, abrasive type action which can be unpleasant for sensitive skin. It also excessively removes the natural body oils causing excessive drying of the skin.

For persons with more sensitive skin such as young children, infants, the elderly etc; those who are ill or ailing; those who have afflicted or injured skin such as burns, wounds, abrasions etc; those who have internal injuries and sprains or injured bones etc; the abrasive, scraping type action of normal towelling can be painful, irritating, and even damaging to the skin.

It is an object of the present invention to eliminate these discomforts and possible damages. In general terms the towel is looped over and has a slippery inner surface so that in using this towelling the coefficient of friction is less on the inner slippery surfaces than on the outer layer of the towel. Thus, externally applied hand pressure with its lateral movement and the still greater coefficient of friction of that part of the towel which is in contact with the wet skin causes the outer half of the towel to slide over the inner half of the towel thus producing a roll-blotting effect. Consequently drying of the skin occurs with no lateral movement of that part of the towel which is in contact against the wet skin, and no abrasive scraping type action takes place resulting in a gentle blotting of the moisture to dry the skin.

The outer half of the towel may also be grasped and bunched in the hand and passed laterally over the lower half of the towel for drying purposes if one so desires with the same effect, The stroke distance of the lateral hand motion in the drying process is limited to the size of the towel and/or the dimensions of the area being dried.

The following description referring to the attached drawing will readily explain the invention as claimed.

FIG. 1 is a cross section of the towel.

A towel 10 has external absorbent drying surfaces 1,2 and inner surfaces, 3,4 formed from a slippery lining or unitized coating. A large number of different fabrics may be used for the inner lining of the towel and it has been found that a number of the mostly fine textured fabrics worked equally well as slippery surfaces lining the towel. A unitized material is preferred in which the back is applied in the manufacturing process to cut down on bulk and labour and materials costs. A plasticised backing has been found particularly suitable.

The towel consists of a normal drying towel one surface of which has a backing coat of a different fabric, or is treated directly so that the towel backing itself, is slippery when wet and/or dry. The towel is then doubled over and joined to form an endless loop in the form of a hollow cylinder or flattened box which resembles a thicker normal towel with the inner surface being in contact over the area denoted 5 in the drawing.

When the towel is applied to any wet surface of a body for drying, the external drying surface that is in contact with the wet surface remains stationary, while light hand pressure applied to the other external drying surface induces lateral movement and causes relative sliding movement between the inner surfaces 3,4. This produces a roll-blotting motion to effect drying and actually blots up the moisture in question with no abrasive, scraping type action of the skin as is the case when wiping with a normal towel.

This is due to the lower coefficient of friction of the two slippery inner surfaces of the towel as opposed to greater friction of the outer surfaces of the towel, one in contact with the wet skin and the other (outside layer) which is under combined hand pressure and lateral movement.

No lateral movement of that portion of the towel against the wet skin takes place and consequently no abrasive or scraping action takes place as in normal towelling which when wiped across the skin produces the abrasive scraping of the towel surface across the skin.

The lateral movement may also be induced by grasping the external drying surface not in contact with the skin so that the towel is bunched and limited movement may be achieved with scraping the towel surface across the skin.

I claim:

1. A towel formed from a length of material connected along opposite transverse edges to define an endless loop having a pair of external drying surfaces each defined between a pair of opposite longitudinal edges, said surfaces overlying one another with said longitudinal edges in register and unconnected to allow relative movement between said surfaces, said surfaces facing in opposite directions, said material having a backing to present a pair of opposed inner surfaces separating said external surfaces on the interior of said loop the coefficient of friction between said inner surfaces being less than the coefficient of friction between the external surface and a body against which it is applied to facilitate relative movement between said inner surfaces said backing constituting means to permit relative movement between said external drying surfaces and thereby cause a rolling movement of said external drying surfaces of said towel along a body surface upon application of a force to the other drying surface in a direction parallel to the one drying surface.

2. A towel formed from a length of material connected along a pair of opposed edges to define an endless loop with a pair of opposed external surfaces and a pair of internal surfaces in sliding engagement, said internal surfaces being provided by a backing providing such surfaces with a coefficient of sliding friction less than the coefficient of friction between said external surface and a body surface to be wiped said backing constituting means permitting relative sliding movement between said internal surfaces and rolling of said external surface along said body surface.

3. A towel according to claim 2 wherein said loop is formed from two materials connected to one another along adjacent surfaces whereby the unconnected surfaces provide said external surface and internal surface respectively.

4. A towel according to claim 2 wherein said internal surface is provided as a coating on the material of said loop.

5. A towel according to claim 4 wherein said coating is formed from a plasticised material.

* * * * *